US005539958A

United States Patent [19]

Cadieux et al.

[11] Patent Number: 5,539,958

[45] Date of Patent: Jul. 30, 1996

[54] AERODYNAMIC FORMING HOOD AND METHOD OF OPERATION

[75] Inventors: Serge Cadieux, Pierrefonds; Yvon L'Heureux, Cap-de-la-Madeleine; Stéphane St-Cyr, Trois-Rivières; Berthier Roy, Danville; Scott L. Gamble, Kitchener, all of Canada

[73] Assignees: Groupe Laperrière et Verreault, Trois-Rivières; Cascades Inc., Kingsey-Falls, both of Canada

[21] Appl. No.: 527,721

[22] Filed: Sep. 13, 1995

[51] Int. Cl.[6] ..... D01G 25/00; D01G 27/00; B65G 53/44

[52] U.S. Cl. ..... 19/304; 19/105; 19/296; 19/308; 406/78; 406/82

[58] Field of Search ..... 19/105, 97.5, 296, 19/300, 301, 302, 304, 307, 308; 406/77, 78, 82, 107, 108, 151, 152, 153, 154, 191, 195; 244/204, 207, 208, 209

[56] References Cited

U.S. PATENT DOCUMENTS

| | | | |
|---|---|---|---|
| 3,521,837 | 7/1970 | Papst | 244/209 X |
| 4,637,104 | 1/1987 | Mente | 19/304 X |
| 4,688,301 | 8/1987 | Thorbjornsson et al. | 19/304 X |
| 4,693,201 | 9/1987 | Williams et al. | 244/208 X |
| 4,712,277 | 12/1987 | Gustavsson | 10/304 X |
| 4,734,957 | 4/1988 | Lenzen | 19/105 |
| 4,956,896 | 8/1990 | Wilder et al. | 19/304 X |
| 5,005,261 | 4/1991 | Pinto et al. | 19/105 |
| 5,038,345 | 1/1992 | Leifeld | 19/105 |
| 5,328,301 | 7/1994 | Oirschot | 406/191 X |
| 5,337,455 | 8/1994 | Pinto et al. | 19/105 |

*Primary Examiner*—John J. Calvert

[57] ABSTRACT

An aerodynamic forming hood is provided for supplying a substantially uniform distribution of fibers in a downward laminar airstream for the deposition of the fibers on one or more forming surfaces. The hood is formed by a rectangular housing having opposed elongated downwardly diverging side walls and short downwardly diverging end walls. The housing has a smaller rectangular open top end through which a supply of fibers is released in an airstream which enters into the housing. The forming surfaces are disposed at a larger bottom forming end of the housing. The side walls and end walls in the top part of the hood are provided with elongated horizontal apertures. Controllable suction boxes are connected to the apertures for the controlled evacuation of air and fibers through the slots to substantially eliminate the formation of air turbulence and hence boundary layer separation in the airstream inside the housing to obtain the said laminar airstream with a substantially uniform distribution of fibers therein.

21 Claims, 3 Drawing Sheets

AERODYNAMIC FORMING HOOD AND METHOD OF OPERATION

TECHNICAL FIELD

The present invention relates to an aerodynamic forming hood for supplying a substantially uniform distribution of fibers in a downward laminar airstream for deposition of the fibers on one or more forming surfaces. Particularly, but not exclusively, the forming hood of the present invention is for use with an air forming system having a lickerin at a top end thereof for releasing fibers in an airstream injected into the hood.

BACKGROUND ART

Fiber mat forming systems equipped with a lickerin in a top end of a diffuser chute are usually limited in capacity to about 500 kg/hr to produce a web thickness of about 5 cm, and this is due primarily to the formation width, in the machine direction, of the forming surface. This formation width is limited to about 20 cm because the airflow within the chute cannot be expanded from a small width at the lickerin level without affecting the uniformity of the web formation. Too large an expansion in the chute creates airflow boundary layer separation, that is to say, airflow deviation to a side wall of the chute, and this has an adverse effect on the distribution of fibers and the formation profile across the machine direction. It has been found that the problem of boundary layer separation is severely increased when the forming length, that is to say, the length across the machine direction, is larger than the lickerin length.

We have found from experiments that a major cause of improper lay-down of fibers on the forming belt is due primarily to the presence of stalled airflow or separated airflows near the entrance portion of the chute or diffuser. Experimentation has also shown that such deviated airflow within the diffuser duct also cause increased static pressure in the flow-wise direction within the duct, and hence produces boundary layer separation.

Through computational fluid dynamics modeling techniques we have established that steep gradients of static pressure are present in the upper part of the diffuser, and recovery to near atmospheric pressure is achieved only very close to the forming surfaces in the bottom of the diffuser. Such modeling techniques have also revealed that flow separation starts in the corners or the duct at the top end and grows on the side wall opposite the top end of the forming belt. Flow separation causes clumping and non-uniform lay-down of fibers on the forming belt, and this is undesirable as the fiber mat produced does not have uniform density.

The above noted boundary layer formation problem was researched and it was observed in the literature dealing with diffusing wind tunnels, where such problems also occur, that a possible solution is to apply suction in the duct in the area of turbulence or boundary layer formation to ensure that the airflow remained attached to the walls of the tunnel. Such solutions are discussed in an article entitled, "Structure of a separating turbulent boundary layer", Part 1, Mean Flow and Reynold Stresses, published in the Journal of Fluid Mechanics, Vol. 113, 1981, pp. 23–51, Simpson et al. Such solution however posed difficult problems when dealing with forming diffusers in which the air stream contains fibers of different types and which may be in admixture with powdered glue or other products.

SUMMARY OF INVENTION

Through experimentation with suction slots provided in the chute, we have discovered that it was possible to construct an aerodynamic forming hood capable of overcoming the above mentioned problems wherein suction could be independently controlled in various stages or sections of the forming hood without sucking out an appreciable amount of fibers contained within the airstream such that a substantially uniform distribution of fibers would be present in the airstream for deposition on one or more forming surfaces disposed at the bottom of the hood.

According to the present invention we also provide a forming hood formed in three sections wherein the top section only is provided with slots in its downwardly diverging side walls and end walls and wherein the suction pressure in the end walls and side walls are independently controlled.

Another feature of the present invention is to provide a plurality of parallel slots in the top portion of the forming hood wherein each slot has an upwardly inclined slot cavity to minimize the extraction of fibers from the airstream.

Another feature of the present invention is to provide a method of supplying a laminar airstream with a substantially uniform distribution of fibers in a forming hood having vacuum slots therein for deposition on one or more forming surfaces in a bottom section of the hood wherein boundary layer formation is substantially eliminated.

According to the above features, from a broad aspect, the present invention provides an aerodynamic forming hood for supplying a substantially uniform distribution of fibers in a downward laminar airstream for deposition of the fibers on one or more forming surfaces. The hood is formed as a rectangular housing having opposed elongated downwardly diverging side walls and short downwardly diverging end walls. The housing has a smaller open top end through which a supply of the said fibers is released in an airstream extending into the housing. The forming surfaces are disposed at a larger bottom forming end of the housing. The side walls and end walls are provided with aperture means in at least a top portion of the housing. Controllable air evacuation means is connected to the aperture means for the controlled evacuation of air and fibers in the airstream to substantially eliminate the formation of air turbulence and hence boundary layer separation in the airstream inside the housing to obtain the substantially uniform distribution of fibers in the airstream.

According to a still further broad aspect of the present invention there is provided a method of supplying a laminar airstream with a substantially uniform distribution of fibers in a forming hood for deposition of the fibers on one or more forming surfaces in a bottom section of the hood. The hood has a rectangular housing having opposed elongated downwardly diverging side walls and short downwardly diverging end walls. The method comprises the steps of providing an airstream in a top open end of the housing. Fibers are injected in the airstream at the top end. Aperture means are provided in the side walls and end walls in a top portion of the hood and air and fibers are evacuated through the aperture means to substantially eliminate the formation of air turbulence and boundary layer separation in the airstream.

BRIEF DESCRIPTION OF DRAWINGS

A preferred embodiment of the present invention will now be described with reference to the accompanying drawings in which.

DESCRIPTION OF PREFERRED EMBODIMENTS

Figure 1A:
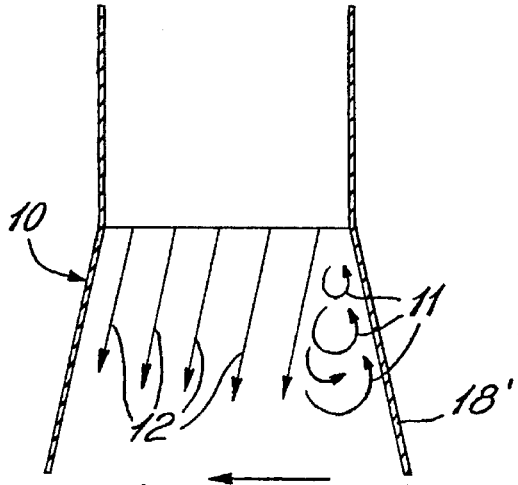
FIG. 1A is a schematic view of a top end of a forming machine, as seen in the machine direction, illustrating the airflow boundary layer separation.
Figure 1B:
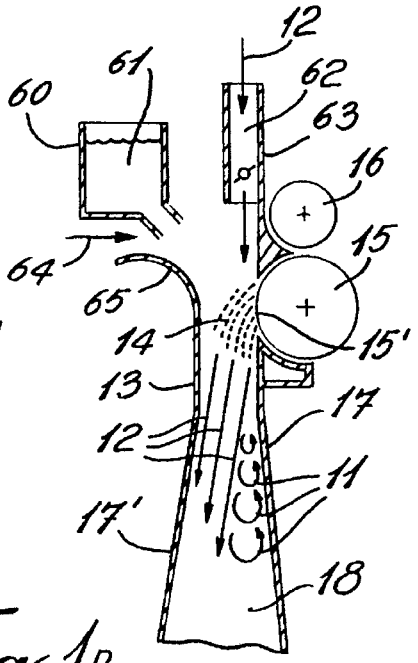
FIG. 1B is a side view of FIG. 1A together with an illustration of the lickerin and additional apparatus that may be provided above the lickerin, and further illustrating the airflow boundary layer separation in the diffuser, but as seen transverse to the machine direction.
Figure 2:
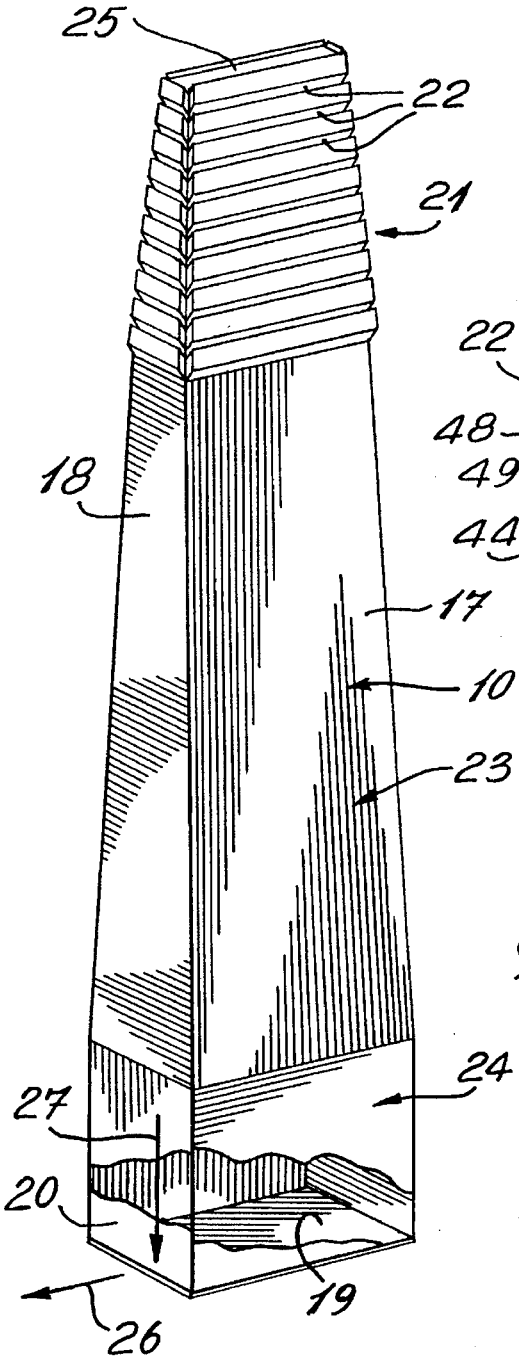
FIG. 2 is a perspective view, partly fragmented, showing the construction of the aerodynamic forming hood of the present invention.

Referring now to FIGS. 1A and 1B, there is shown a schematic illustration of a diffuser housing or hood 10 and illustrating the formation of air boundary layer separation at 11 caused by the airstream 12 which enters the upper end 13 of the hood housing 10 carrying therein fiber particles 14. The fibers 14 are released in the airstream 12 by a lickerin 15, which is essentially a cylindrical drum, above which a feeder roll 16 injects particles which are dispersed within the airstream 12 passing in front of an exposed section 15' of the lickerin. This airflow boundary layer separation 11 is caused by the expansion in the flow created by the diverging side walls 17 and diverging end walls 18 of hood causing the airstream at 12' to diverge towards the side wall 17' and the end wall 18'. It is pointed out that the end walls 18' may extend parallel to one another, although not illustrated herein but obvious to a person skilled in the art. The purpose of the diffuser housing is to deliver the fibers 14 in suspension in the airstream upon one or more forming surfaces 19 and 20, as shown in FIG. 2, located in the lower end or the forming end 21 of the hood. The flow separation starts in the corners in the upper part of the hood and grows on the side wall opposite the forming surface 20. This airflow boundary layer separation 11 causes clumping or non-uniform distribution of fibers on the belt.

Referring now additionally to FIGS. 2 and 3, there is shown the construction of the modified aerodynamic forming hood 10 of the present invention. As herein shown, the hood 10 is constructed as a three-stage housing. The uppermost stage 21 is provided with a plurality of slots or apertures 22 disposed in spaced parallel relationship throughout the side wall 17 and end wall 18. These side walls 17 and end walls 18 are also downwardly diverging walls so that the lower section of the intermediate stage 23 and lower stage 24 is larger than the open top end 25. The intermediate and lower stages are formed with solid walls. The lower forming stage 24 is of uniform rectangular cross-section and constitutes the forming chamber. The forming surfaces 19 and 20 are constituted by perforated webs, as described in detail in my copending U.S. patent application Ser. No. 08/345,638 filed Nov. 28, 1994 and entitled "FIBER MAT FORMING METHOD, MACHINE AND PRODUCT". The bottom horizontal web constituting the forming surface 19 which is displaceable in the machine direction, as indicated by arrow 26, and the vertically transverse web constitutes the forming surface 20 which is displaced downwardly transverse to the machine direction, as indicated by arrow 27.

Figure 8:
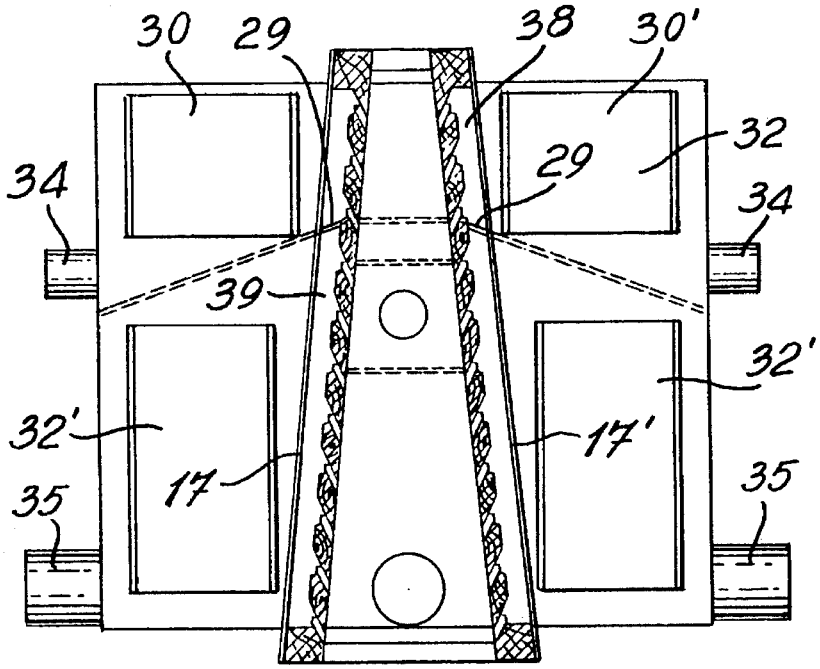
FIG. 8 is a side view showing the suction boxes connected to the side walls of the uppermost portion of the forming hood.
Figure 9:
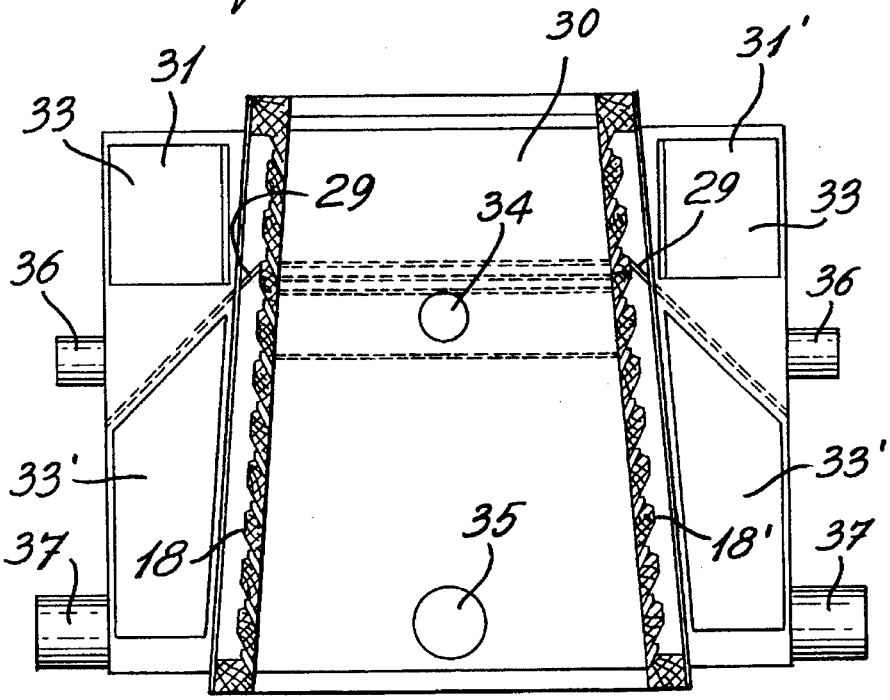
FIG. 9 is a side view showing the suction boxes connected to the end walls of the uppermost portion of the forming hood.

As previously mentioned, airflow boundary layer separation occurs in the top portion of the forming hood and accordingly, by sucking air through the slots 22, it is possible to control the distribution of air pressure within the airstream. Because boundary layer separation is more predominant in certain portions of the side and end walls in the top section 21 of the hood 10, it is important that the suction be controlled independently on each of the side and end walls 17 and 18, respectively. This is achieved, as shown in FIGS. 8 and 9, by the provision of suction boxes 30 and 30' secured to the side walls 17 and 17' respectively, and further suction boxes 31 and 31' secured to the end walls 18 and 18' respectively. Each of the suction boxes 30, 30' and 31, 31' is divided by divider walls 29 in two compartmental sections 32 and 32' for the suction boxes 30 and 30' and 33 and 33' for the suction boxes 31 and 31'. Ports 34 and 35 connect to the sections 32 and 32' respectively while ports 36 and 37 connect to the suction box sections 33 and 33' respectively of suction box 31. A vacuum pump (not shown) connects to each of these ports and is independently controlled so that the suction through the slots 22 can be varied for each of the sections in the end and side walls, independently, to substantially eliminate the formation of boundary layer separation by sucking air and fibers therethrough to prevent airstream deviation, as illustrated by the arrows 12 in FIG. 1A.

Figure 3A:
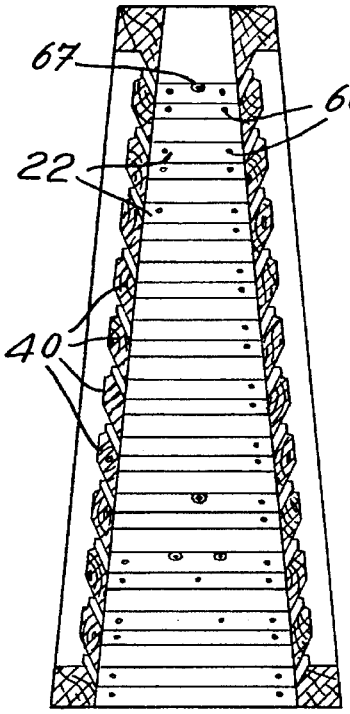
FIG. 3A is a transverse section view showing the construction of the end wall of the uppermost stage of the forming hood provided with suction slots.
Figure 3B:
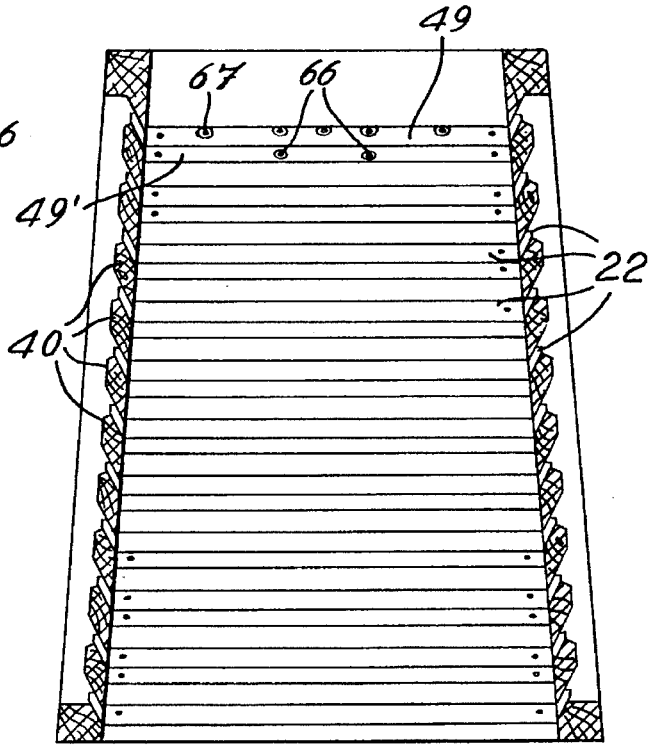
FIG. 3B is a section view similar to FIG. 3A illustrating the slots provided in the side walls of the forming hood.
Figure 4:
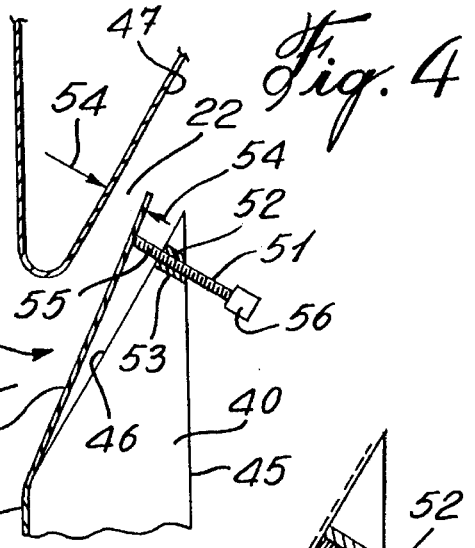
FIG. 4 is a section view through a slot showing the adjustment feature of the slot opening.
Figure 5:
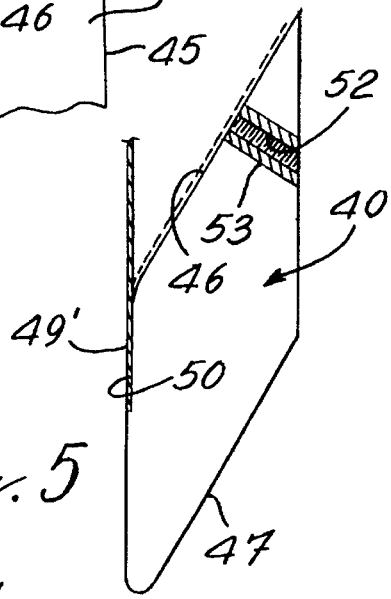
FIG. 5 is a section view showing the construction of a rib forming the slots.
Figure 7:
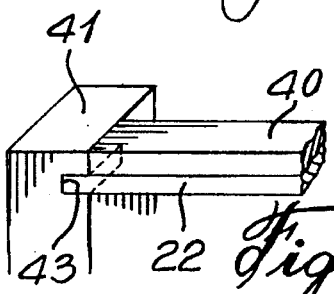
FIG. 7 is a fragmented perspective view of the corner post illustrating the corner slot.
Figure 6:
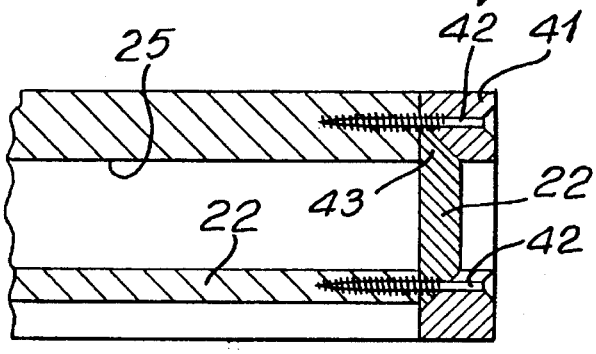
FIG. 6 is a top section view showing the connection of the ribs to a corner post and the interconnection corner slot provided in the post.

Referring now more specifically to FIGS. 3 to 6, there will be described the construction of the uppermost stage 21 of the forming hood which is provided with the slots 22. As herein shown, the upper stage section 21 is constructed by a plurality of ribs 40 having a specific shape, as shown in FIGS. 4 and 5, and retained in spaced parallel relationship by corner posts 41. The ribs 40 are secured to the corner posts 41 by screw fasteners 42, as shown in FIG. 6. The slots 22 define elongated rectangular openings across the side walls and end walls 17 and 18 respectively. These openings 22 are also disposed in planar alignment and interconnect with one another through corner slots 43 formed in the post 41 in alignment thereto whereby suction is also created in the corners of the hood in an area susceptible to the formation of airflow boundary layer separation.

As shown in FIGS. 4 and 5, the ribs 40 are formed with a forward and rear surface 44 and 45 disposed substantially parallel to one another, and an upwardly inclined upper surface 46 and upwardly inclined lower surface 47 also extending substantially parallel to one another. These surfaces 46 and 47 are inclined upwardly rearwards from the mouth opening 48 of the slot 22. The rib 40 is also provided with a metal sheath 49 at least on the inclined upper surface 46 and secured at a lower end 49' thereof within a locating cavity 50 formed on the upper surface 46 of the rib. This elongated sheath 49 is suitably a metal sheath formed of flexible material capable of retaining its shape and having secured adjacent a free end thereof one or more adjustment screws 51 which are threadably received within a bore 52 of a threaded insert 53 provided in a rearward top portion of the rib 40 whereby the sheath 49 can be adjusted for displacement above the surface 46 to vary the opening, as shown between arrows 54, of the slot 22. The free end 55 of the screw is connected to the sheath 49 and the rear end is provided with a tool receiving head 56 whereby rotation can be imparted to the adjustment screw 51. Accordingly, each of the slots in the side wall 17 and end wall 18 and in each of the sections 32 and 32' of the suction boxes 30 and 30' and sections 33 and 33' of the suction boxes 31 and 31' can be adjusted to achieve a laminar (non-turbulent) airstream throughout the uppermost section 21 of the forming hood.

It is pointed out that the forming surfaces 20 and 19 at the forming end section 21 of the hood 10 is disclosed in my aforementioned U.S. patent application. It is also pointed out that it is possible to inject other type material or fibers or dry glue particles into the airstream 12 by the provision of a dispenser 60, as shown in FIG. 1B, above the lickerin 15 whereby additional particles 61 may be introduced within the airstream 12. Furthermore, a plurality of spaced guide plates 62 may be adjustably secured against the side wall 63 of the upper housing above the lickerin 15, and disposed in the airstream 12 created by a blower (not shown) to adjust the direction and distribution of airflow in the injected airstream to assist in the reduction of air turbulence and consequently boundary layer separation in the hood 10.

Briefly summarizing the method of operation of the former hood supply of a uniform distribution of fibers within an airstream injected into the top open end of the hood 10, the method comprises the provision of apertures or slots 22 in the upper section 21 of the hood and evacuating or providing suction of air and fibers through the slots or apertures. This suction substantially eliminates the formation of air turbulence and consequently boundary layer separation, as shown at 11 in FIGS. 1A and 1B, from the airstream 12. The slots 22 also extend on an upward incline to reduce the quantity of fibers extracted therethrough. Although not shown, it is pointed out that a return airflow with the fibers extracted through the suction boxes is provided to recycle back the fibers for injection into the lickerin 15. The method consists in the adjustment of the orifice of the slots and the control of the suction in groups of slots such that these groups are independently controlled. Still further, ambient air is introduced in the open end of the hood, as shown by arrows 64 in FIG. 1B, on a curved surface 65 in a manner to further prevent boundary layer formation. The ambient air entering the hood for admixture with the airstream 12 acts as an air equalizer to prevent vacuum or pressure operating conditions. Vacuum or pressure operating conditions would affect the mat formation or the density of the fibers in the mat. The ambient air also serves as a conveyance means for the injection of other particles or fibers 61 within the airstream.

As shown in FIGS. 3A and 3B, the ribs 40 are constructed of wood, but it is understood that these may be fabricated from other suitable materials. Also, the sheathes 49 as herein shown are secured by fasteners 66 in the lower section of 49' of the sheath and the end 55 of the adjustable fasteners 51 are secured to the sheath by additional fasteners 67.

A typical design of the hood, as herein shown, may have an inlet opening in the range of 12×30 inches and expands at the former stage to a cross-sectional dimension of about 24 to 36 inches over a length of about 135 inches. The uppermost section of the hood has a length of about 39 inches whereas the intermediate section 23 has a length of 96 inches. The total length of the hood, as herein shown, is 163 inches. It is pointed out that these dimensions were set by criteria—as the smaller the throat width of the upper opening becomes, the higher the adverse (increasing) pressure gradient in the upper portion of the hood. This rapidly makes the hood more susceptible to airflow separation. It is also important to take into consideration the airflow through the forming surfaces 19 and 20 which, although not shown herein, are subjected to suction by additional suction boxes. It is therefore important to calculate all of the suction flow rates which are required to draw off the boundary layers upstream of the hood, and in adjusting the suction boxes additional care must be taken to estimate how much fiber is sucked through the slots in the upper stage 21 of the hood. In the present design it is also pointed out that eleven slots were calculated as providing maximum efficiency in the upper section of the hood, and these have been spaced uniformly thorough this upper stage. The basic characteristics of the suction system were determined by computational fluid dynamics technique and were estimated at 500 CFM total flow through a 36-inch wide forming belt on the surfaces 19 and 20, 1400 CFM total flow through the eleven suction slots 22 in the upper stage of the hood, 6400 CFM total flow in through the open top end 25 the opening of which was 4.5×24 inches and 8500 FPM air speed through the throat. The slots were also spaced 4 inches apart.

It is within the ambit of the present invention to cover any other obvious modifications provided such modifications fall within the scope of the appended claims.

We claim:

1. An aerodynamic forming hood for supplying a substantially uniform distribution of fibers in a downward laminar airstream for deposition of said fibers on one or more forming surfaces, said aerodynamic forming hood formed as a rectangular housing having opposed elongated downwardly diverging side walls and short downwardly extending end walls the walls defining a top portion, a middle portion and a bottom forming end portion said housing having a open top end, which is of a smaller perimeter than the bottom end, and extends into said housing, the open top end accepting a supply of fibers for release into an airstream said one or more forming surfaces being disposed at said larger bottom forming end of said housing, said side walls and end walls being provided with aperture means in at least said top portion of said housing, said aperture means being a plurality of parallel slots, controllable air evacuation means connected to said aperture means for the controlled evacuation of air and fibers in said airstream and for substantial elimination of the formation of air turbulence and boundary layer separation in said airstream so as to obtain said substantially uniform distribution of fibers in said airstream.

2. A forming chute as claimed in claim 1 wherein said slots in said side walls and end walls being disposed in planar alignment.

3. A forming chute as claimed in claim 2 wherein said air evacuation means are suction boxes connected to groups of said plurality of parallel slots, said boxes each being independently controlled to adjust a vacuum therein for controlling the suction flow of air and fibers therethrough.

4. A forming chute as claimed in claim 3 wherein each said side wall and end wall in said top portion of said housing is provided with a top suction box and a secondary suction box, said vacuum in the suction boxes of said end walls being stronger than said vacuum in the suction boxes of said side walls.

5. A forming chute as claimed in claim 2 wherein the slots each have an elongated rectangular opening across said side walls and end walls and spaced opposed inner surfaces, the inner surfaces being disposed rearward and upwardly inclined from said rectangular opening to minimize fiber content in evacuated air from said air stream through said slots.

6. A forming chute as claimed in claim 5 wherein one of the inner surfaces is displaceably adjustable to position the inner surfaces towards or away from the other of the inner surfaces to adjust an open surface area of said slot.

7. A forming chute as claimed in claim 6 wherein said one of the inner surfaces is an elongated sheet disposed over an inclined lower support wall, and one or more adjustment screws threadably secured in said wall and connected to said elongated sheet adjacent a free end thereof to adjustably incline said elongated sheet towards or away from the other upper inner surface.

8. A forming chute as claimed in claim 5 wherein said slots are formed between a plurality of ribs secured between four corner posts of said housing, said plurality of ribs having rearwardly and upwardly inclined top and bottom surfaces forming an upwardly inclined slot therebetween, the posts having angled corner slots to interconnect the side wall slots to the end wall slots in said planar alignment therewith.

9. A forming chute as claimed in claim 1 wherein a lickerin is disposed above said open top end of said diffuser housing to supply said fibers in an air stream directed at said open top end by air blower means.

10. A forming chute as claimed in claim 10 wherein said lickerin is a cylindrical feed drum disposed in alignment with an upper end of one of the side walls of the hood housing and having a discharge opening to feed fibers in said airstream, and an ambient air intake adjacent said discharge opening above a convexly curved wall disposed at an upper op end of the other side walls of the housing to assist in the prevention of said boundary layer formation by serving as an air equalizer to prevent vacuum or pressure operating conditions.

11. A forming chute as claimed in claim 11 wherein there is further provided supply means disposed adjacent said convexly curved wall to inject other type materials or fibers for admixture in said airstream.

12. A forming chute as claimed in claim 9 wherein there is further provided a plurality of spaced guide plates disposed in said airstream above said lickerin to adjust direction and distribution of airflow in said airstream so as to assist in the reduction of air turbulence and boundary layer separation in the hood housing.

13. A forming chute as claimed in claim 1 wherein the three-stage housing, the intermediate and lowermost stages having solid side walls and end walls, the lowermost stage being of rectangular section with parallel side and end walls and defining a forming section in which said one or more forming surfaces are disposed.

14. A forming chute as claimed in claim 13 wherein the uppermost one of said stages is about one quarter the length of said three-stage housing.

15. A forming chute as claimed in claim 1 wherein the end walls are outwardly diverging end walls.

16. A forming chute as claimed in claim 1 wherein the end walls are parallel end walls.

17. A method of supplying a laminar airstream with a substantially uniform distribution of fibers in a forming hood for deposition on one or more forming surfaces in a bottom section of said hood, said hood being formed by a rectangular housing having opposed elongated downwardly diverging side walls and short downwardly diverging end walls, said method comprising the steps of (i) providing an airstream in a top open end of said housing;

(ii) injecting fibers in said airstream at said top open end, (iii) providing aperture means in said side walls and end walls in at least an upper end of said housing;

(iv) evacuating air and fibers through said aperture means to substantially eliminate the formation of air turbulence and boundary layer separation in said airstream in said housing; and (v) distributing the fibers uniformly on a fiber forming surface.

18. A method as claimed in claim 17 wherein said aperture means are elongated slots having upwardly and upwardly inclined opposed surfaces, and suction boxes connected to groups of said elongated slots, there further being comprised the step of individually controlling a vacuum in said suction boxes to control the evacuation of air and fibers in groups of slots independently from one another to achieve a laminar airstream within said housing.

19. A forming chute as claimed in claim 18 wherein there is further provided the step of independently adjusting an orifice of said slots.

20. A forming chute as claimed in claim 18 wherein there is further provided the step of injecting ambient air in said airstream at said upper end of said housing.

21. A forming chute as claimed in claim 18 wherein there is further provided the step of adjusting the position of a plurality of spaced guide plates in said upper end where said fibers are injected to adjust the direction and distribution of air flow from an air blower to assist in the reduction of air turbulence and boundary layer separation in said top end of said housing.

* * * * *